US011767703B2

(12) United States Patent
Alarcon et al.

(10) Patent No.: US 11,767,703 B2
(45) Date of Patent: Sep. 26, 2023

(54) SAFE DOOR WITH MOVABLE BOLT PAN

(71) Applicant: ROLLAND SAFE & LOCK COMPANY, LLC, Dallas, TX (US)

(72) Inventors: Miguel Alarcon, Quito (EC); Richard Rolland, Dallas, TX (US)

(73) Assignee: Rolland Safe & Lock Company, LLC, Dallas, TX (US)

( * ) Notice: Subject to any disclaimer, the term of this patent is extended or adjusted under 35 U.S.C. 154(b) by 317 days.

(21) Appl. No.: 17/032,875

(22) Filed: Sep. 25, 2020

(65) Prior Publication Data

US 2021/0095515 A1 Apr. 1, 2021

Related U.S. Application Data

(60) Provisional application No. 62/906,370, filed on Sep. 26, 2019.

(51) Int. Cl.
*E05G 1/04* (2006.01)
*E05B 65/00* (2006.01)

(52) U.S. Cl.
CPC ..... *E05G 1/04* (2013.01); *E05B 65/0075* (2013.01)

(58) Field of Classification Search
CPC ..... E05G 1/04; E05B 65/0075
USPC ..... 109/59 R, 74
See application file for complete search history.

(56) References Cited

U.S. PATENT DOCUMENTS

2013/0154462 A1* 6/2013 Cho ..... E05B 65/0082 70/1.5

FOREIGN PATENT DOCUMENTS

| | | | | |
|---|---|---|---|---|
| CN | 106014088 A | * | 10/2016 | |
| CN | 108360920 A | * | 8/2018 | |
| CN | 108798361 A | * | 11/2018 | ..... E05B 47/0012 |
| CN | 109025655 A | * | 12/2018 | ..... E05B 17/186 |
| CN | 109209141 A | * | 1/2019 | ..... E05B 47/0002 |
| CN | 110107154 A | * | 8/2019 | ..... E05B 15/00 |
| DE | 3941426 A1 | * | 6/1991 | |
| EP | 1164246 A2 | * | 12/2001 | ..... E05B 65/0075 |

* cited by examiner

*Primary Examiner* — Suzanne L Barrett
(74) *Attorney, Agent, or Firm* — Katten Muchin Rosenman LLP

(57) ABSTRACT

Disclosed herein is a movable bolt pan in which the bolt pan frame is secured directly to a safe door. The positions of securement of the bolt pan frame to the safe door are spread across a large percentage of the door slab. An entirety of the leading edge of the movable bolt pan contacts the door jamb of the safe when the movable bolt pan is in the closed position. A handle on an exterior of the safe door can be used to slide the movable bolt pan laterally from the closed position to the open position, allowing the safe to be opened.

13 Claims, 8 Drawing Sheets

SAFE DOOR WITH MOVABLE BOLT PAN

CROSS-REFERENCE TO RELATED APPLICATIONS

This application claims priority to U.S. Provisional Application Ser. No. 62/906,370, filed Sep. 26, 2019, the entire contents of which are hereby incorporated by reference in their entirety.

FIELD OF THE INVENTION

The present invention discloses a safe door in which the entire bolt pan is movable to secure the safe door in the locked position.

BACKGROUND

The B rated safe is probably the most misunderstood safe in the market today. Essentially, B rated safes are designed to hold limited amounts of cash or valuables for short periods of time where the safe is placed in a location that is not left unattended. The general idea is to ward off attempts at armed robbery during open hours and to support CIT (cash in transit or armored car) operations. The introduction of this safe in the late 1960's was primarily focused on managing cash and supporting chain of custody of bank deposits within a retail, restaurant, or service organizations. Because of these minimal security expectations, manufacturers of B rated products typically use a light gauge steel to construct the safe and its associated deposit compartment, usually incorporated in to the design of the safe. These safes are lightweight and not particularly recognized as a burglary resistive container. Client users of the B rate safes recognizes the safe's door, bolts, and combination lock and almost automatically assume that the safe is designed to resist an attack from burglary tools. This assumption is not supported by the construction of the safe.

As a point of knowledge, the actual term "B rated" is a moniker anomaly in itself. The term B rate was derived in part from the ISO (Insurance Services Office) commercial lines manual which offered a classification system to assist underwriters in a variety of subjects that address certain risk assessment practices. The ISO manual mentioned safes in terms of metal thickness and what type of lock was being used to secure the safe. For instance, an ISO B classified safe was to be constructed from steel less than ½ inch thick on the door and ¼ inch thick on the body. ISO is not a testing organization, but only assigns classifications by construction.

Underwriters Laboratories, on the other hand, is a testing organization. Their nomenclature is about ratings of safes (under spec. 687), being physically tested as to their resistance to burglary attacks by specified list and attack times and burglary tools. Ironically, UL doesn't have a test for a B class constructed safe.

The name anomaly is created by combining the UL rating system with the ISO classification system, and referring to the light metal safes a "B rates", which technically should be called "B classified".

As society evolves, the risk of loss or mysterious disappearance of cash deposits take on a different level. The loss is not the cash deposit missing as much it is the consequences surrounding the manager who is held responsible. Additionally, the introduction of analytical camera and surveillance systems makes the risk of armed robbery less commonplace. What is at higher risk today are cash deposits and controlling the chain of custody of those deposits. CIT (armored car) services are becoming more prevalent in the US as national brands would rather pay for this service than to risk mysterious disappearance or the "walk to bank" practice for store managers to take. Traditionally, B rated safes are owned by user clients, and CIT companies are given restricted access to the compartment where the prepared deposits wren stored. When the CIT service needed access to the compartment where the deposits are kept, a condition of dual custody exists, as the store manager must be present to open the outer door that protects that mangers compartment.

Today, "smart safes" also manufactured in the B rate construction, accept cash notes instead of prepared deposit and network the exact amount of funds in the safe to offsite management. Typically, these notes can only be removed by CIT or senior management. This allows for a strong deterrence to armed robbery as well as mitigation of mysterious disappearance. The alternative to smart safes is still the traditional B rated safe. The emphasis of its value becomes driven towards armed robbery risk mitigation and protecting the chain of custody for cash deposits. As the distinction between traditional B rated safes and smart safes broaden, it is imperative that the cost differentiators be apparent. Therefore, a need still exists for a way to reduce the cost of manufacturing a B rate safe while allowing for the overall strength of the door to body interface to be increased.

SUMMARY

The present invention discloses a movable bolt pan in which the bolt pan frame is secured directly to a safe door. The positions of securement of the bolt pan frame to the safe door are spread across a large percentage of the door slab. An entirety of the leading edge of the movable bolt pan contacts the door jamb of the safe when the movable bolt pan is in the closed position. A handle on an exterior of the safe door can be used to slide the movable bolt pan laterally from the closed position to the open position, allowing the safe to be opened.

BRIEF DESCRIPTION OF THE DRAWINGS

Embodiments of the present invention are illustrated by way of example, and not limitation, in the accompanying figures in which like references denote similar elements, and in which.

DETAILED DESCRIPTION

Figure 1:
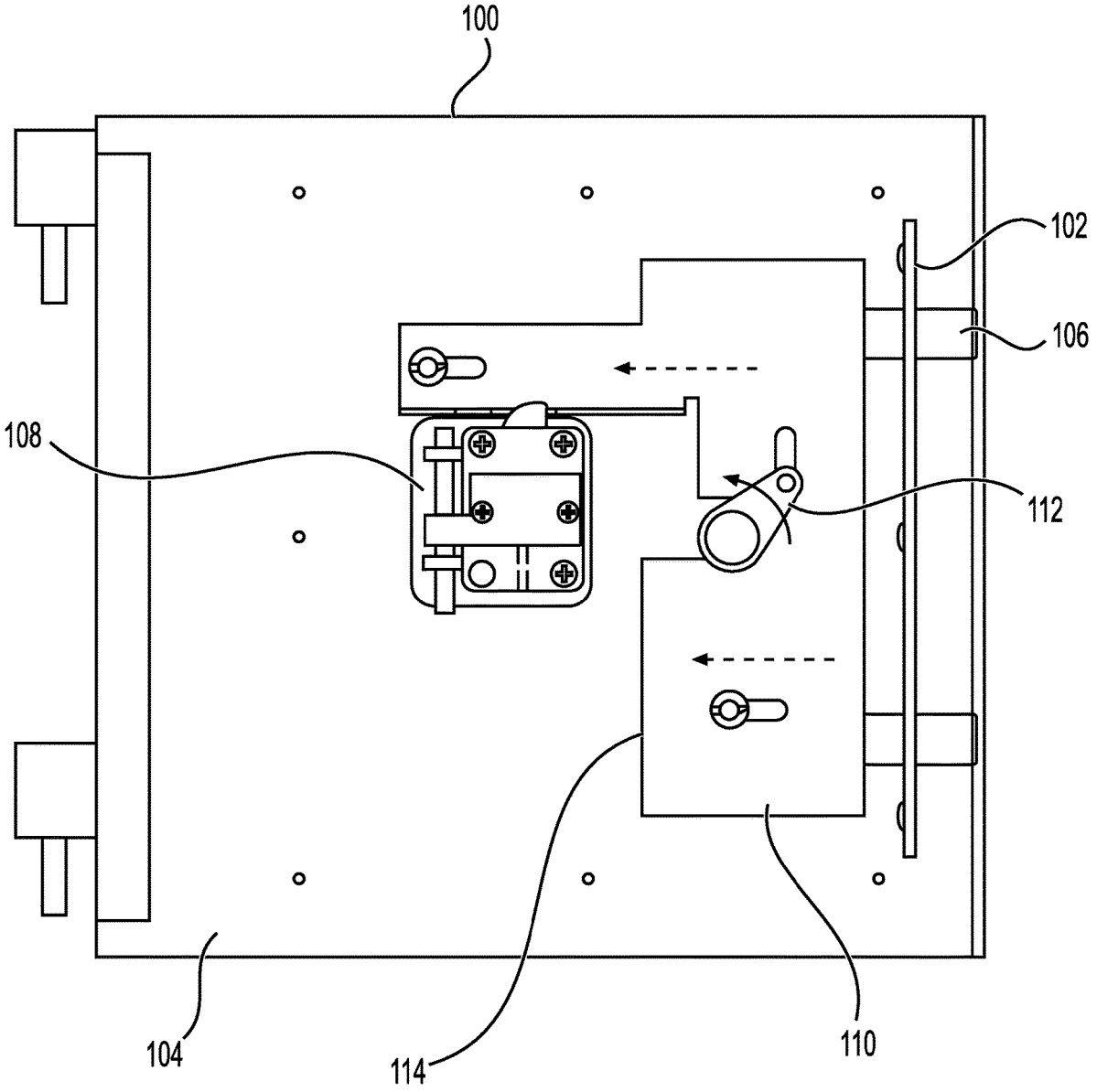
FIG. 1 (RELATED ART)
FIG. 1 depicts a boltwork mechanism utilized in a common B rate safe.

FIG. 1 depicts the traditional bolt system 100 of a B rated safe. Generally, the bolt system 100 comprises a bolt guide bar 102 welded to the safe door 104. Two or three bolts 106 extend through the bolt guide bar 102 and secure the safe door 104 in a locked position. A lock 108 prevents the bolt work 110 from being retracted until lock 108 is opened.

Figure 2:
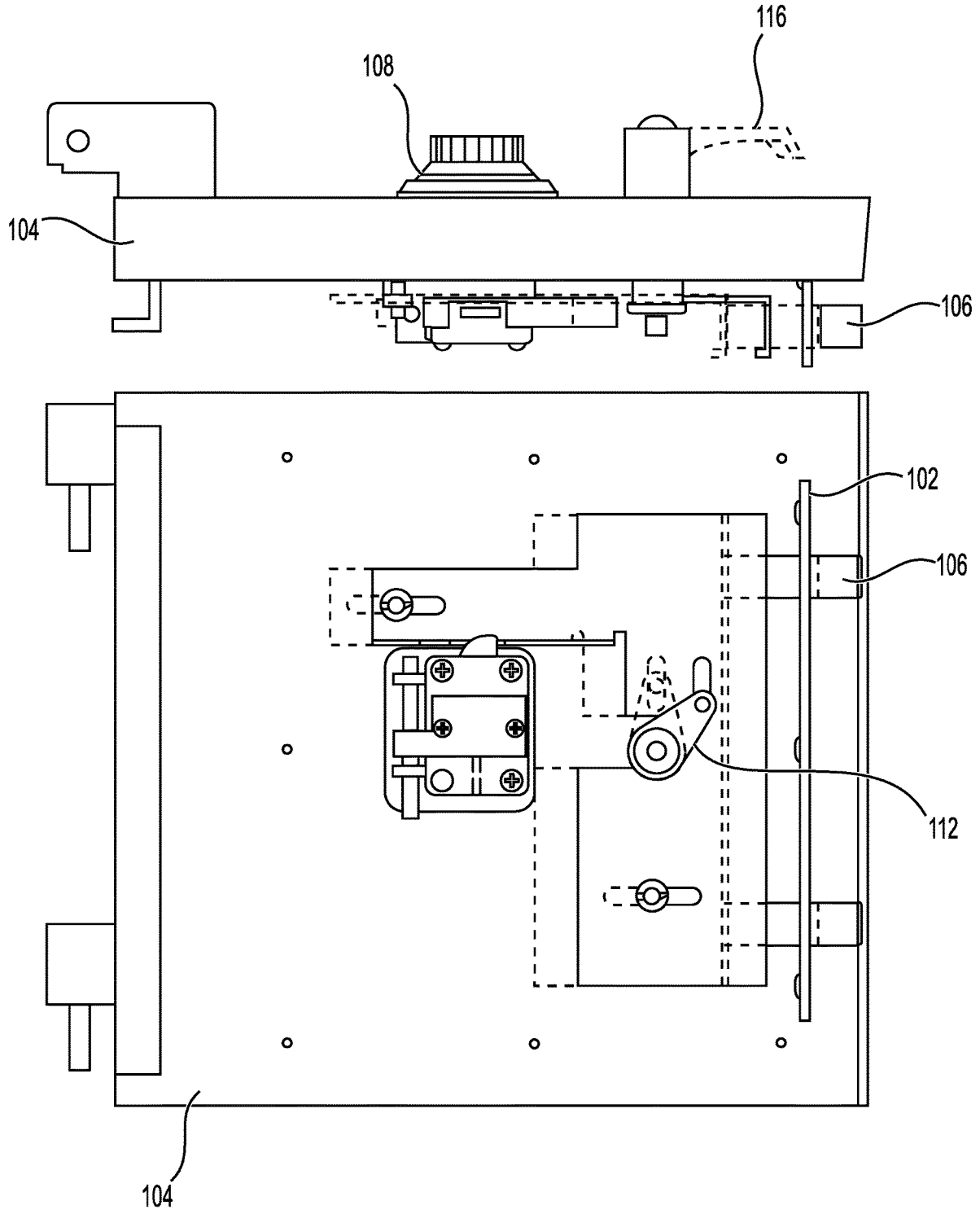
FIG. 2 (RELATED ART)
FIG. 2 depicts the boltwork mechanism of FIG. 1 being opened.

Rotation of the exterior handle 116 of on the safe door 104 causes bolt cam actuator 112 to rotate as depicted in FIG. 2. The bolt work 110 moves to the left and the safe door 104 can be opened. The bolt pan 114, which comprises the perimeter frame of the bolt work 110 and the back cover, does not move.

Figures 3A, 3B, 3C:
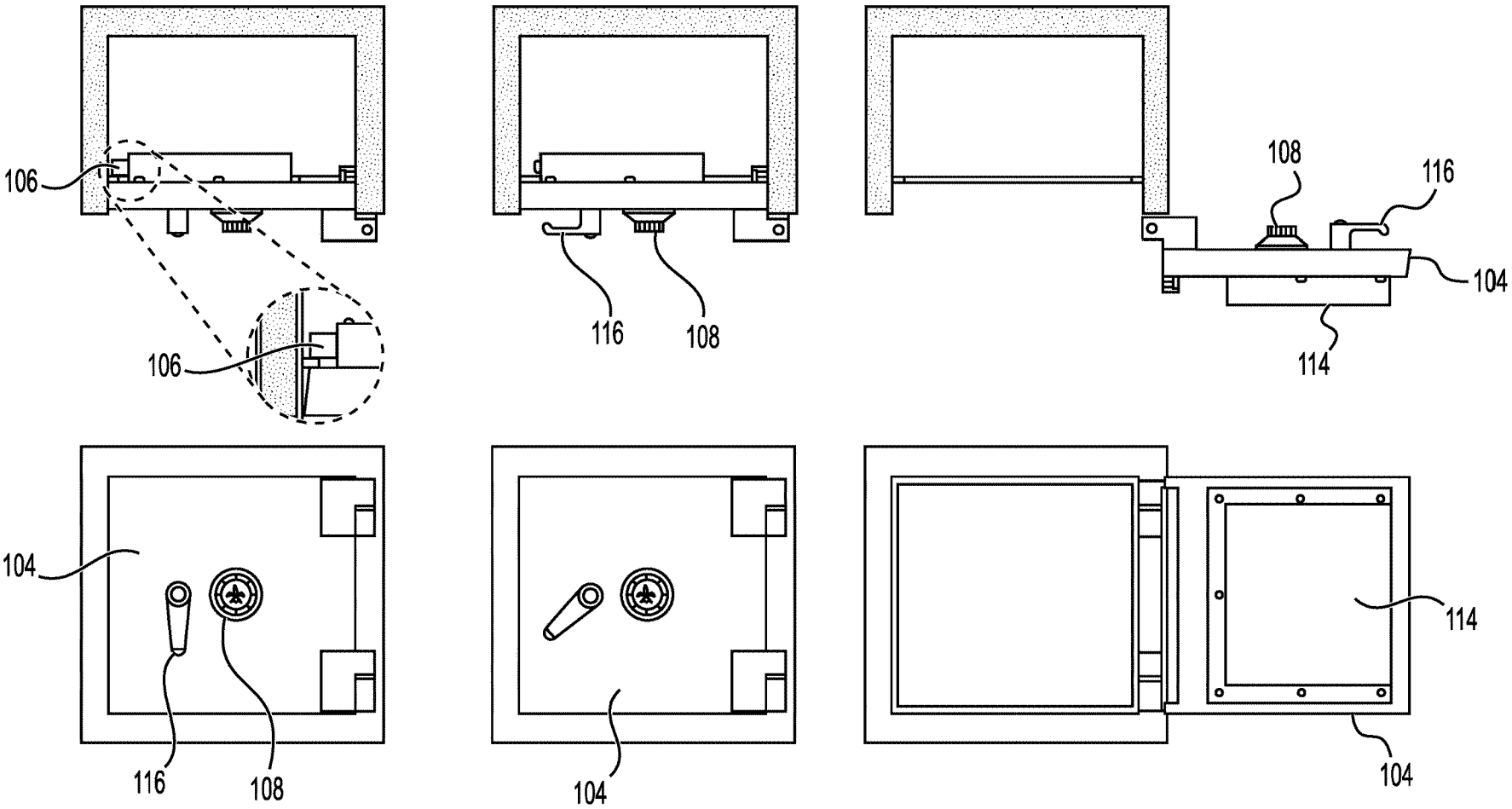
FIG. 3B (RELATED ART)
FIGS. 3A-3C depicts an overhead view of the boltwork mechanism of FIG. 1 being opened.

FIGS. 3A-3C depicts the steps used to open bolt system 100 in an overhead and front view. FIG. 3A shows the bolts extended. After lock 108 has been opened, the handle 116 can be turned to retract bolts 106 as depicted in FIG. 3B. The safe door 104 can then be opened as depicted in FIG. 3C.

The bolt pan 114 is typically constructed of a lighter metal than the rest of the safe and is fastened to safe door 104 with machine screws. The bolt pan 114 may additionally have a hole drilled in the surface corresponding to the position of lock 108 to allow it to be changed without removing bolt pan 114.

While the bolt system 100 may appear massive enough to hold the safe door 104 closed in its locked positon, the reality is that it is that it is only the limited surface contact of bolts 106 against the bolt guide bar 102 that holds the entire safe locking mechanism together. Also, the welds holding bolt guide bar 102 to safe door 104 are subject to failure during a prying attack.

Figure 4A:
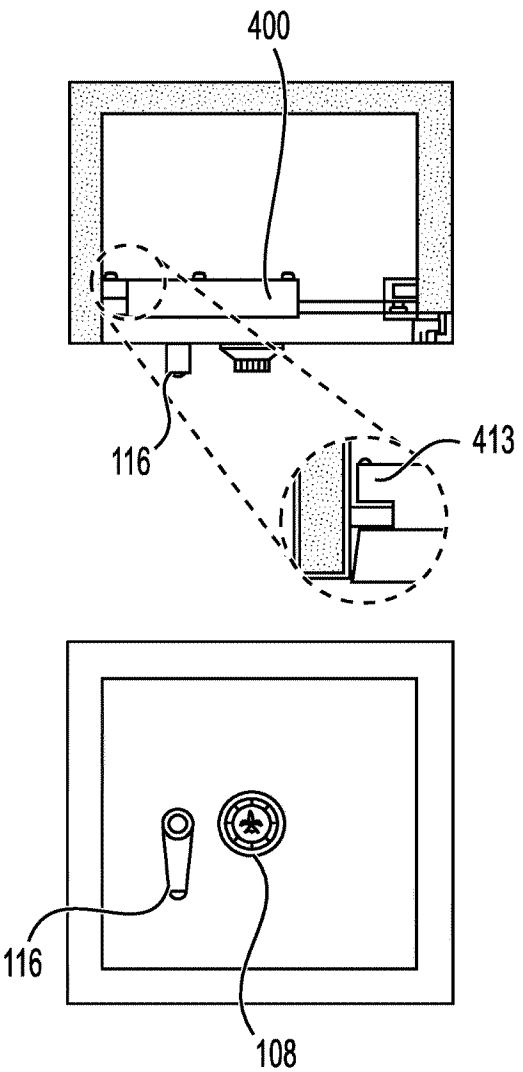
FIGS. 4A-4C depicts the movable bolt pan of the present invention being opened.
Figure 4B:
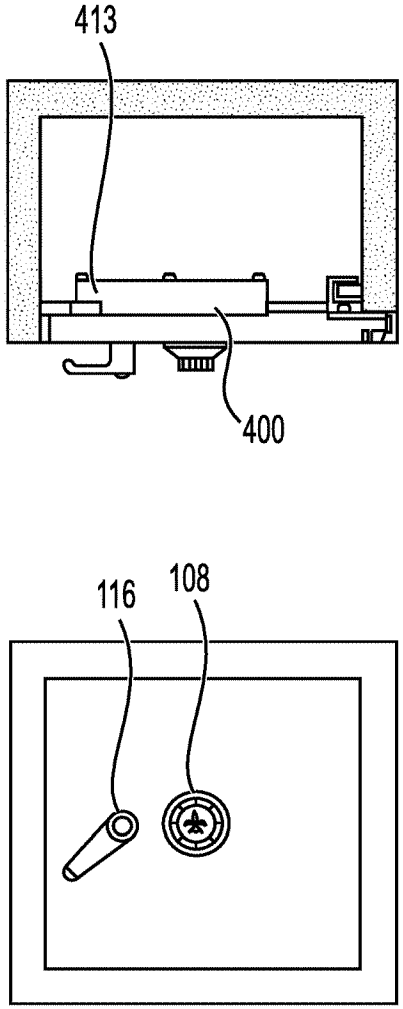
Figure 4C:
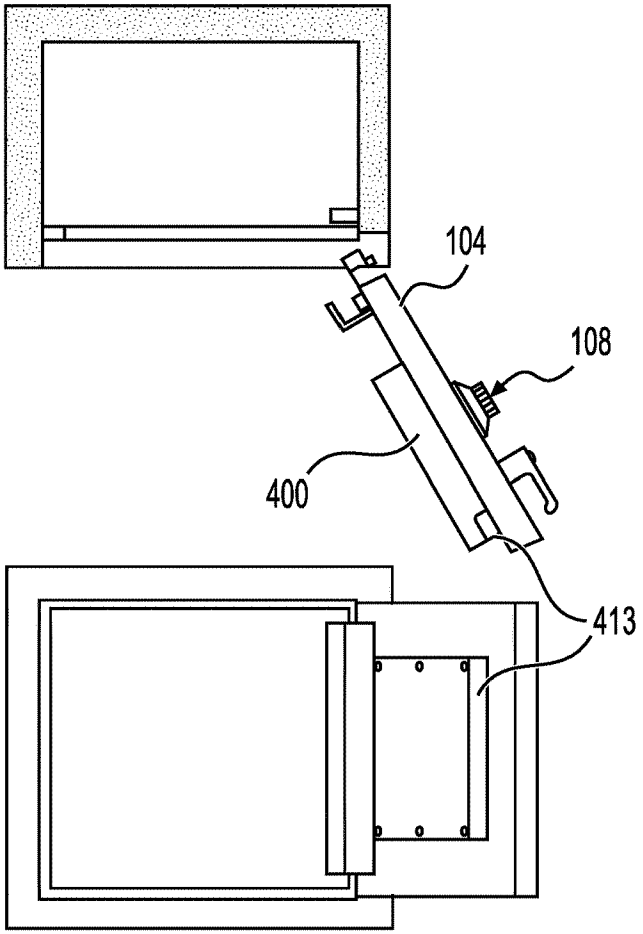

Referring next to FIG. 4, depicted is the movable bolt pan 400 of the present invention. The movable bolt pan 400, in contrast to bolt system 100, offers a more cohesive attachment between the safe and the safe door 104, as it utilizes the entire bolt pan (fabricated in a stronger thickness of metal) as its locking mechanism. In this design, the "bolt" that secures the safe door is supported by the strength of the entire bolt pan, offering more protection to the locked safe door. Unlocking of lock 108 and turning of handle 116 causes the entire movable bolt pan 400 to retract as shown in FIG. 4B. FIG. 4C illustrates that the entire right side (in the image) of movable bolt pan 400 is used to secure safe door in the locked position as opposed to just bolts 106.

Figure 5:
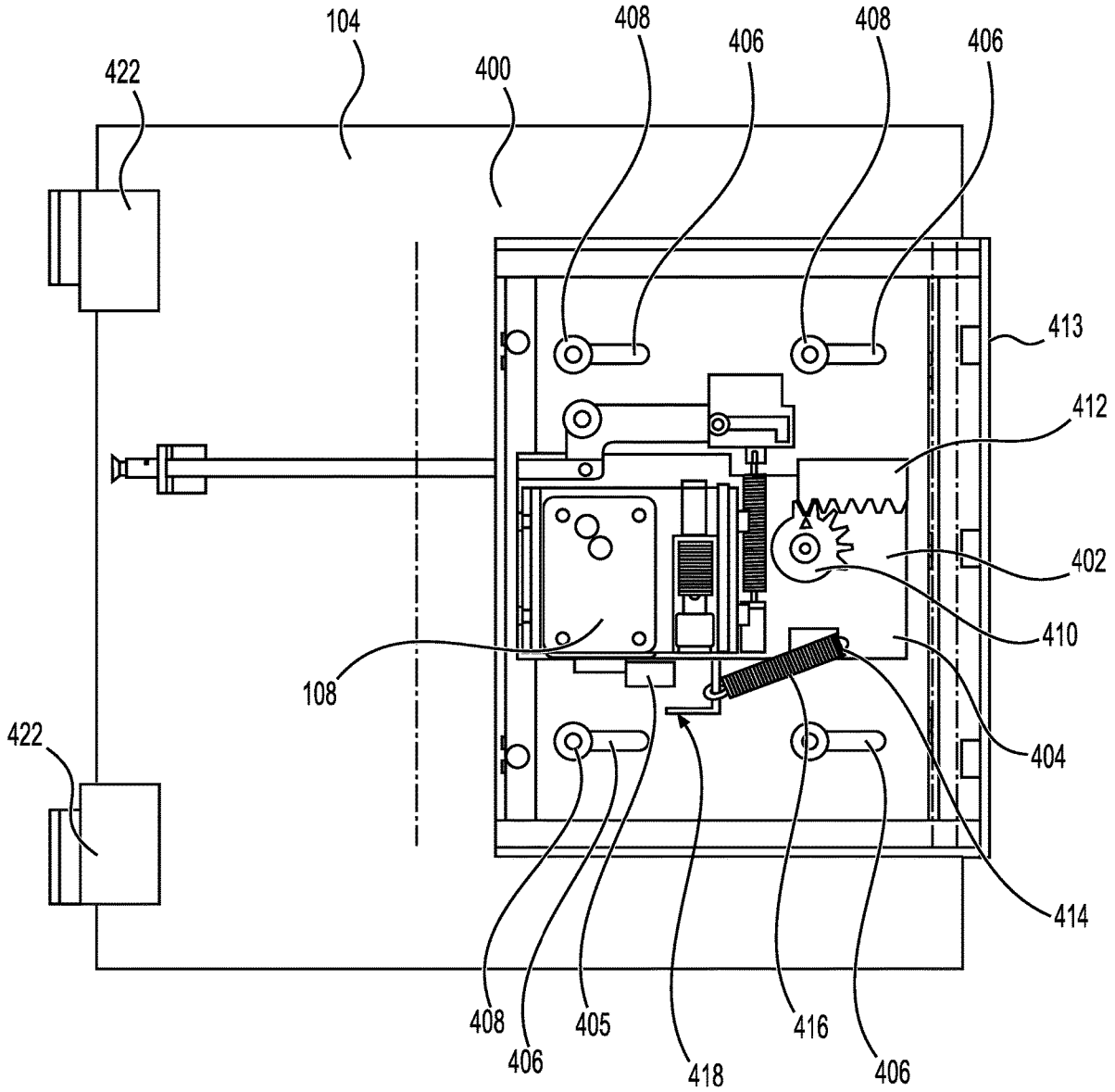
FIG. 5 depicts a schematic view of an interior of a safe door showing the features of the movable bolt pan.
Figure 6:
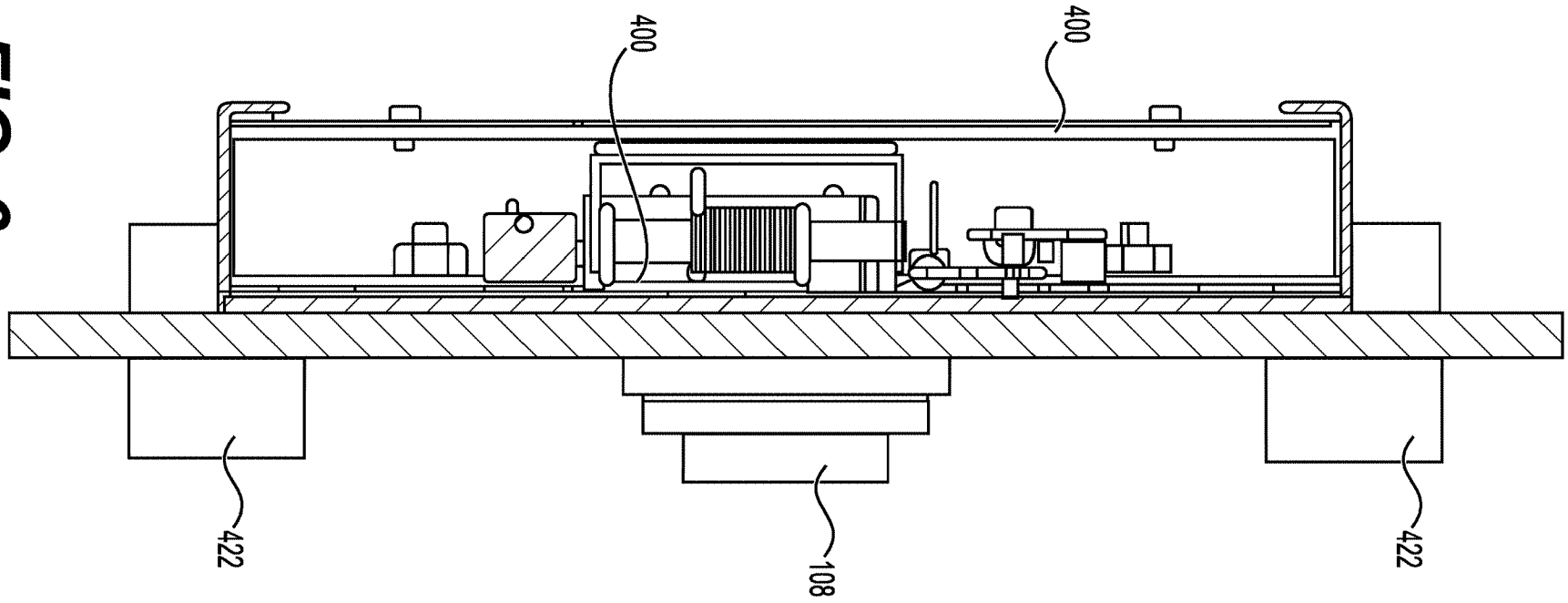
FIG. 6 depicts a cross-sectional view of the movable bolt pan.

Referring next to FIGS. 5 and 6, depicted is safe door 104 having movable bolt pan 400 coupled thereto with the rear cover removed to show the components of movable bolt pan 400. All of the components of movable bolt pan 400 are coupled to bolt pan frame 402 which is square or rectangular in shape. Bolt pan frame 402 has a relief cavity 404 through which the rear of lock 108 extends. When the lock 108 is engaged, it abuts lock block 405 as depicted in FIG. 5. This prevents any lateral movement of movable bolt pan 400.

Figure 8:
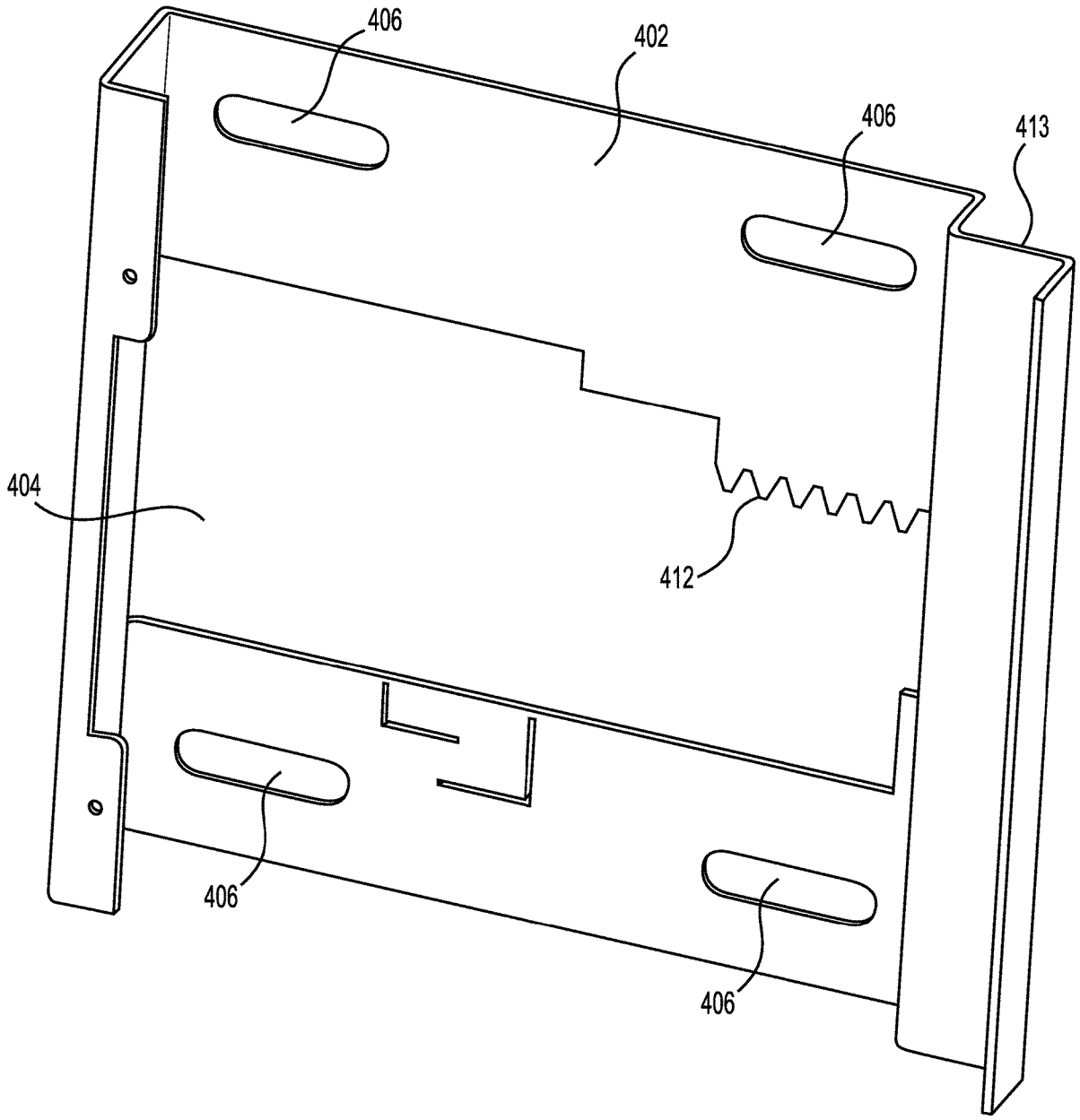
FIG. 8 depicts a perspective view of the pan frame in isolation.

Lock 108 remains stationary whereas movable bolt pan 400 can move left/right. Specifically, bolt pan frame 402 further comprises four horizontal grooves 406 located at corners of bolt pan frame 402 (FIG. 8). Slide attachment bolts 408, placed through horizontal grooves 406, secure movable bolt pan 400 to safe door 104 while still allowing horizontal movement.

It should be apparent that additional horizontal grooves 406 and attachment bolts 408 may be provided. For example, bolt pan frame 402 may comprise additional grooves 406 other than those shown at any other locations as long as they do not interfere with the sliding of movable bolt pan 400.

Figure 7:
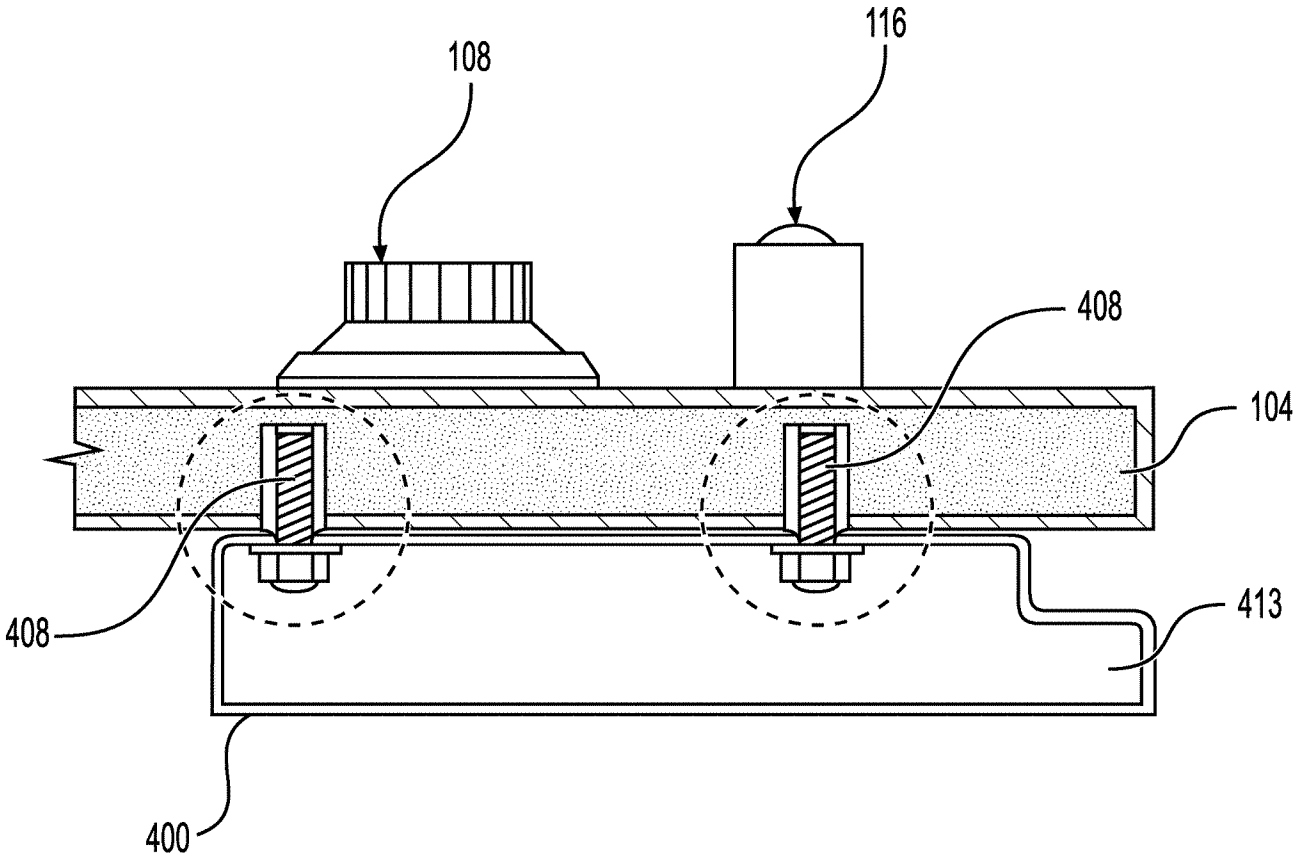
FIG. 7 shows a cross-sectional view depicting the attachment of the movable bolt pan to a safe door.

The positions that the movable bolt pan 400 is fastened to the safe door 104 are spread over 50% of the door slab. Further, as depicted in FIG. 7, the shafts of slide attachment bolts 408 extend into the composite barrier material of safe door 104 for a secure attachment. This creates a superior leverage, creating a stronger deterrent to a pry attack of the safe door 104 from the body. Instead of the traditional design of two or three filet welds on a single bolt slide bar on the edge of the safe (FIGS. 1-3), the movable bolt pan 400 supports the locking bar in four anchor positons across the slab of the safe door 104.

Once the lock 108 is unlocked, handle 116 can be turned which causes bolt pinion gear 410 to concurrently be turned through a connection shaft. The bolt pinion gear 410 is coupled to the same surface as the lock 108 and protrudes through relief cavity 404 of bolt pan frame 402. The teeth of bolt pinion gear 410 interfaces with the teeth of bolt gear rack 412 of bolt pan frame 402. Thus, the turning of bolt pinion gear 410 also causes bolt pan frame 402 to move to the left which unlocks safe door 104 as depicted in FIG. 4C. The safe door 104 can be locked by reversing the described process.

Bolt pan frame 402 further comprises leading bolt edge 413 which is best seen in FIG. 8. The leading bolt edge 413 has a thickness less than the remainder of bolt pan frame 402 and extends the entire length of the edge of bolt pan frame 402. Leading bolt edge 413 engages the door jamb of the safe when movable bolt pan 400 is in the locked configuration.

Safe door 104 may further comprise a detent spring support 414 coupled to a first end of a detent spring 416. The other end of detent spring 416 is coupled to relocker stop 418. Relocker stop 418 is a component of relocker 420 which are well known in the art for providing backup security for safes.

An opposing edge of safe door 104 preferably comprises two or more hinges 422 for attaching safe door 104 to the body of the safe. And, as previously mentioned and depicted in FIG. 6, the entire rear of movable bolt pan 400 comprises locking mechanism access cover 424.

In sum, the movable bolt pan 400 (FIGS. 4A-8) a superior design strength over the traditional B rate bolt system 100 (FIGS. 1-3C):

- The surface area of the leading bolt edge 413 offers more contact with the door jamb of the safe (FIG. 8);
- The positions that the movable bolt pan 400 is fastened to safe door 104 are spread over 50% (or more) of the door slab of safe door 104;
- Slide attachment bolts 408 provide a superior adhesion to the door slab of safe door 104; and
- Movable bolt pan 400 does not require the use of chrome plating of bolts as in bolt system 100, reducing the carbon footprint of the manufacturing process.

Several embodiments of the present invention are specifically illustrated and/or described herein. However, it will be appreciated that modifications and variations of the present invention are covered by the above teachings without departing from the spirit and intended scope of the invention.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the invention in diverse forms thereof. Any one or more features or functions of the first/other aspects/embodiments disclosed above may also be incorporated into the second/present aspect/embodiment, alone or in any combination.

The invention claimed is:

1. A safe comprising:
a safe body;
a safe door movable between an open position and a closed position;
a handle coupled to the safe door;
a lock coupled to the safe door;
a movable bolt pan coupled to an interior of the safe door, the movable bolt pan comprising:
a bolt pan frame;
a plurality of horizontal slits in the bolt pan frame,
wherein the bolt pan frame is secured to the safe door by a bolt placed through each horizontal slit,
wherein each bolt is secured to a door slab of the safe door;
a relief cavity for receiving a rear end of the lock and a bolt pinion gear coupled to the handle; and
a bolt gear rack engaged with the bolt pinion gear,
wherein rotation of the handle from a first position to a second position causes horizontal movement of the bolt pan frame from a locked position to an unlocked position; and
a door jamb arranged along a front surface of the safe body,
wherein a leading bolt edge of the bolt pan frame engages the door jamb when the handle is in the first position.

2. The safe according to claim 1, wherein the leading bolt edge of the bolt pan frame is disengaged from the door jamb when the handle is in the second position to allow the safe door to be moved between the open position and the closed position.

3. The safe according to claim 1, wherein the bolt gear rack comprises a first set of gear teeth which are engaged with a second set of gear teeth of the bolt pinion gear.

4. The safe according to claim 1, wherein rotation of the handle from the first position to the second position causes concurrent rotation of the bolt pinion gear.

5. The safe according to claim 1, wherein the engagement of the first set of gear teeth with the second set of gear teeth causes movement of the bolt pan frame from the locked position to the unlocked position.

6. The safe according to claim 1, wherein the bolt pan frame further comprises:
a block that engages with a bolt of the lock when the lock is engaged, and
wherein unlocking of the lock causes disengagement of the block from the bolt to allow movement of the bolt pan from the locked position to the unlocked position.

7. The safe according to claim 1, wherein the plurality of horizontal slits comprises:
a first set of horizontal slits arranged above a top edge of the relief cavity; and
a second set of horizontal slits arranged below a bottom edge of the relief cavity.

8. The safe according to claim 7,
wherein the first set of horizontal slits and the second set of horizontal slits are spaced such that an area formed by the perimeter of the first set of horizontal slits and the second set of horizontal slits is greater than or equal to 50% of a total surface area of an interior surface of the safe door.

9. A movable bolt pan comprising:
a first set of horizontal slits on a first side of the movable bolt pan;
a second set of horizontal slits on a second side of the movable bolt pan opposite the first side;
a central opening between the first set of horizontal and the second set of horizontal slits;
a set of horizontal gear teeth formed along a first edge of the central opening;
a leading bolt edge coupled to a third side of the movable bolt pan,
wherein the leading bolt edge has a same height as the movable bolt pan; and
a safe block arranged below a second edge of the central opening and above the second set of horizontal slits.

10. The movable bolt pan according to claim 9, wherein the leading bolt edge comprises:
a first surface coupled to the third side of the movable bolt pan;
a second surface coupled to the first surface,
wherein the second surface is perpendicular to the first surface.

11. The movable bolt pan according to claim 10, wherein the leading bolt edge further comprises:
a third surface coupled to the second surface,
wherein the third surface is perpendicular to the second surface, and
wherein the third surface is parallel to the first surface.

12. The movable bolt pan according to claim 11, wherein the first surface, the second surface, and the third surface are planar surfaces.

13. A safe comprising:
a safe body;
a safe door movable between an open position and a closed position;
a handle coupled to the safe door;
a lock coupled to the safe door;
a movable bolt pan coupled to an interior of the safe door, the movable bolt pan comprising:
a bolt pan frame;
a plurality of horizontal grooves in the bolt pan frame,
wherein the bolt pan frame is secured to the safe door by a bolt placed through each horizontal groove,
wherein each bolt is secured to a door slab of the safe door;
a relief cavity for receiving a rear end of the lock and a bolt pinion gear coupled to the handle; and
a bolt gear rack engaged with the bolt pinion gear,
wherein rotation of the handle from a first position to a second position causes horizontal movement of the bolt pan frame from a locked position to an unlocked position,
wherein the plurality of horizontal slits comprises:
a first set of horizontal slits arranged above a top edge of the relief cavity; and
a second set of horizontal slits arranged below a bottom edge of the relief cavity,
wherein the first set of horizontal slits and the second set of horizontal slits are spaced such that an area formed by the perimeter of the first set of horizontal slits and the second set of horizontal slits is greater than or equal to 50% of a total surface area of an interior surface of the safe door.

* * * * *